US009747847B2

(12) United States Patent
Rosenberg et al.

(10) Patent No.: US 9,747,847 B2
(45) Date of Patent: Aug. 29, 2017

(54) DYNAMICALLY UPDATING AN ELECTRONIC PAPER DISPLAY BY COMPUTATIONAL MODELING

(71) Applicant: Amazon Technologies, Inc., Reno, NV (US)

(72) Inventors: Ilya D. Rosenberg, Mountain View, CA (US); Bradley J. Bozarth, Sunnyvale, CA (US)

(73) Assignee: Amazon Technologies, Inc., Seattle, WA (US)

( * ) Notice: Subject to any disclaimer, the term of this patent is extended or adjusted under 35 U.S.C. 154(b) by 121 days.

(21) Appl. No.: 13/721,708

(22) Filed: Dec. 20, 2012

(65) Prior Publication Data

US 2014/0176614 A1 Jun. 26, 2014

(51) Int. Cl.
*G09G 3/34* (2006.01)

(52) U.S. Cl.
CPC ..... *G09G 3/344* (2013.01); *G09G 2320/041* (2013.01); *G09G 2340/16* (2013.01)

(58) Field of Classification Search
CPC ..... G09G 3/344; G09G 2320/041; G09G 2320/046; G09G 2320/048; G09G 2320/025; G09G 2310/063; G09G 2310/0243; G09G 2360/16; G09G 2380/14; G09G 3/00; G09G 3/20; G09G 3/2085; G02F 1/167; G02F 1/172; G02B 26/026
See application file for complete search history.

(56) References Cited

U.S. PATENT DOCUMENTS

| | | | | |
|---|---|---|---|---|
| 8,803,794 | B1 * | 8/2014 | Froment et al. | 345/107 |
| 2003/0137521 | A1 * | 7/2003 | Zehner | G02F 1/167 345/589 |
| 2008/0309612 | A1 * | 12/2008 | Gormish et al. | 345/105 |
| 2008/0309657 | A1 * | 12/2008 | Rhodes et al. | 345/214 |
| 2010/0220122 | A1 | 9/2010 | Zehner et al. | |
| 2011/0187684 | A1 * | 8/2011 | Amundson et al. | 345/204 |
| 2011/0270578 | A1 * | 11/2011 | Van Foeken | 702/188 |
| 2012/0019614 | A1 | 1/2012 | Murray et al. | |
| 2012/0086733 | A1 | 4/2012 | Hudson et al. | |
| 2012/0146975 | A1 * | 6/2012 | de Zeeuw et al. | 345/211 |
| 2013/0194250 | A1 * | 8/2013 | Amundson et al. | 345/212 |

OTHER PUBLICATIONS

PCT Search Report and Written Opinion mailed May 27, 2014 for PCT Application No. PCT/US13/77040, 9 Pages.

* cited by examiner

*Primary Examiner* — Jennifer Mehmood
*Assistant Examiner* — Sardis F Azongha
(74) *Attorney, Agent, or Firm* — Lee & Hayes, PLLC

(57) ABSTRACT

Embodiments provide techniques for updating pixels of an electrophoretic display through computational modeling of a current state of each pixel. A model buffer may store data for a modeled current state of each pixel in a display, providing a prediction of a current color state for each pixel based on voltages previously applied to the pixel. Upon receiving a frame to be displayed, including a target state for each pixel, embodiments determine which of a set of voltages (e.g., positive, negative, or neural/zero voltages) optimally alters the state of the pixel to be as close as possible to the target state. These voltage(s) may be applied to each pixel in an iterative manner, with each voltage determined based on the current modeled state of the pixel.

24 Claims, 7 Drawing Sheets

500

502 504 506

| Current State (e.g., Color) | Applied Voltage | Result State |
|---|---|---|
| 0 | + | 11 |
| 0 | - | 0 |
| 0 | 0 | 0 |
| ⋮ | | |
| 127 | + | 156 |
| 127 | - | 123 |
| 127 | 0 | 141 |
| 128 | + | 161 |
| 128 | - | 111 |
| 128 | 0 | 128 |
| 129 | + | 159 |
| 129 | - | 120 |
| 129 | 0 | 130 |
| ⋮ | | |
| 255 | + | 255 |
| 255 | - | 251 |
| 255 | 0 | 254 |

508

DYNAMICALLY UPDATING AN ELECTRONIC PAPER DISPLAY BY COMPUTATIONAL MODELING

BACKGROUND

Electrophoretic displays, such as electronic ink (e-ink) displays (also referred to as electronic paper displays), employ an array of microcapsules filled with charged pigment particles, each microcapsule providing a pixel of a displayed image. Altering the displayed image involves applying an electric field to the microcapsules to alter the color state of each pixel and thus form the image. For example, in a black-and-white electronic paper display, various positive or negative voltages may be applied to the microcapsules to adjust a color or brightness state of each pixel along a grayscale from white to black to achieve the desired image.

In contrast to other types of displays (e.g., Liquid Crystal Displays (LCDs)) which exhibit a more deterministic relationship between applied signal and resultant image, electrophoretic displays exhibit a memory effect. For example, in electronic paper displays the brightness of each pixel not only depends on the currently applied voltage, but also depends on a history of the voltages that have been applied to the pixel. Thus, the applied voltages necessary to reach a particular color state of a particular pixel may vary based on the previously applied voltages and, in some cases, other factors such as temperature. This memory effect creates difficulties for developers attempting to write programs to control the images displayed on electrophoretic displays.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Overview

Figure 1:
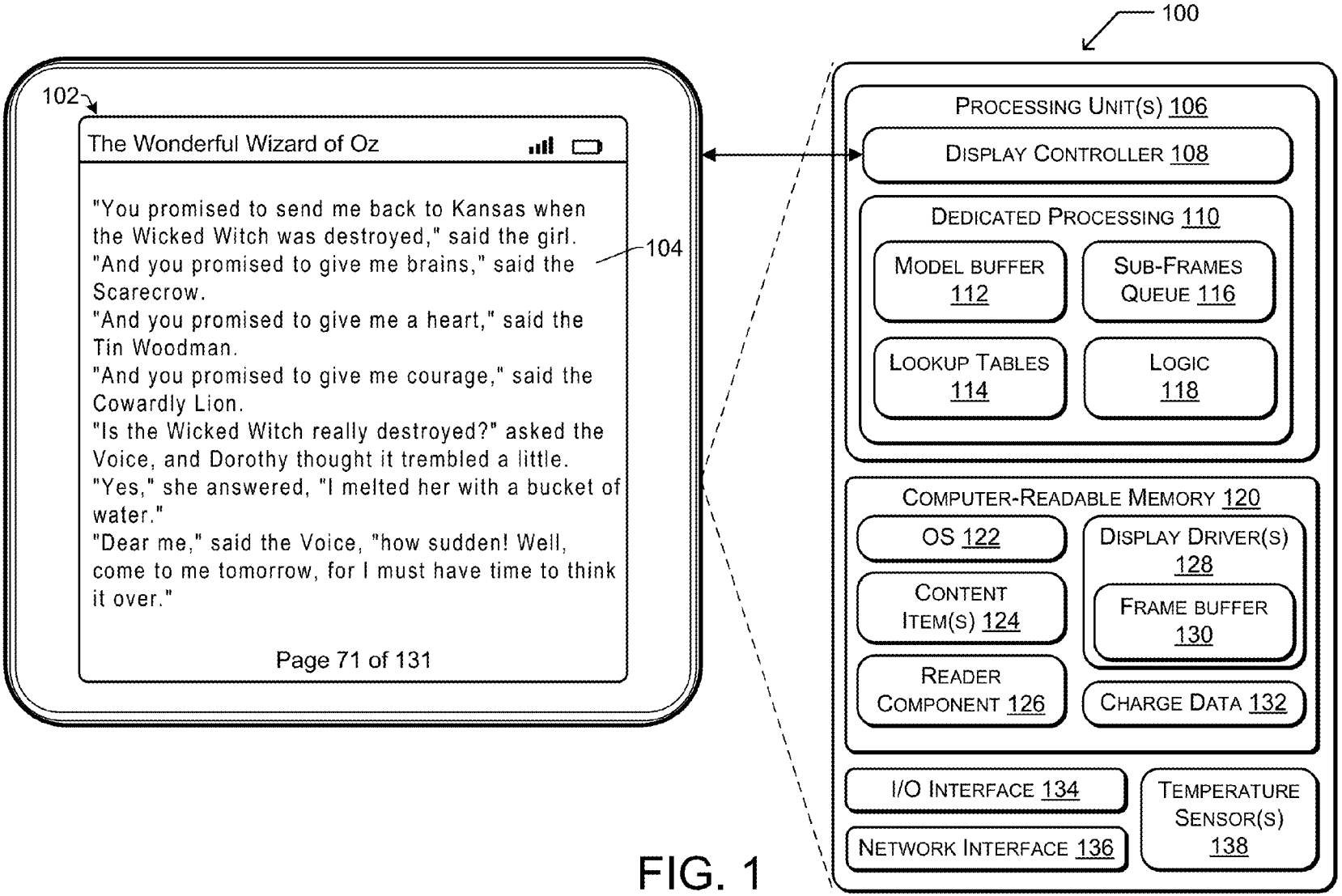
FIG. 1 depicts an example computing device which may perform operations for dynamically updating an electrophoretic display, according to embodiments.

Embodiments provide techniques for dynamically updating pixels of an electrophoretic (e.g., electronic paper) display through computational modeling of a current state of each pixel. In some embodiments, a model buffer or other area of memory may store data for a modeled current state of each pixel in a display, the modeled current state providing a prediction of a current color state for each pixel based on voltages previously applied to the pixel. A frame to be displayed (e.g., an image) may be received and stored in a frame buffer, and a target color state for each pixel may be determined based on the image data in the frame buffer.

Embodiments dynamically determine one or more voltages from a set of voltages (e.g., positive, negative, or neutral/zero voltages) which, when applied to a microcapsule corresponding to a pixel, optimally alter the state of the pixel to be as close as possible to the target color state. These voltage(s) may be applied to each pixel in an iterative manner during one or more sub-frames, with each voltage determined dynamically based on the current modeled state of the pixel. Following application of each of the voltage(s), the modeled current state of each pixel may be updated and stored in a model buffer.

Embodiments may model a grayscale color state for each pixel in a black-and-white display using an eight-bit number that varies from 0 (e.g., white) to 255 (e.g., black). Other scales may be employed, such as a four-bit scale that varies from 0 to 16. For example, given a frame to be displayed, a target color state for a particular pixel may be 200, and the modeled current state of the pixel may be 100, on an illustrative eight-bit scale. Embodiments may dynamically determine which of a set of possible voltages (e.g., positive, negative, or neutral) optimally changes to state of the pixel toward the target state. For example, if applying the positive voltage, negative voltage, or neutral voltage would alter the state of the pixel to be 150, 120, or 95 respectively, then a determination may be made to apply a positive voltage to alter the state of the pixel toward the target state of 200. Following application of this voltage, the modeled current state of the pixel may be updated (e.g., to 150), and another voltage may be determined that alters the pixel state further toward the target state of 200, or another frame may be processed for display.

This process may be iterated during a predetermined number of sub-frames within the time period for display of a frame, and during each iteration the optimal applied voltage may be dynamically determined for each pixel. For example, where frames are received for display at a frequency of 85 Hz, and the system is able to process voltage updates to the display pixels at a frequency of 210 Hz, embodiments may employ two sub-frames per frame and may apply up to two voltages to alter the state of pixels while displaying a frame. Thus, embodiments may provide for a dynamic determination of a voltage to apply during each one or more iterations, instead of applying a series of voltages that have been predetermined (e.g., at the time the display was manufactured) for each pixel in the display.

In some embodiments, dynamic determination of each optimal voltage to apply to a pixel is based on a lookup table that maps a current voltage to a result voltage that results from application of each of a set of voltages (e.g., positive, negative, or neutral). The development of such a lookup table is described in further detail below. Moreover, in some embodiments, the dynamic determination of the optimal voltage to be applied may be based on a mathematical algorithm that algorithmically models the behavior of a pixel in response to an applied voltage. Use of this algorithmic model may be in place of, or in addition to, the use of the lookup table.

In some embodiments, the modeled current state of each pixel may diverge over time from the actual current state, leading to ghosting effects or other anomalies in the displayed image. To correct such effects, embodiments may apply one or more de-ghosting voltages to all pixels or to a subset of pixels in the display. The de-ghosting voltages applied to a pixel may be determined, through use of the lookup table and/or algorithmically, as those voltage(s) that alter the state of the pixel to an extreme state (e.g., either fully white or fully black, 0 or 255). The direction chosen, white or black, may be based on which is closer to the modeled current state of the pixel. In this way, forcing the pixel to a known state (e.g., white or black) may serve as a calibration for the pixel, allowing subsequent pixel alterations to begin again with a higher confidence that the modeled current state more accurately predicts the actual current state of the pixel. Further, by forcing each pixel to whichever of the two extremes (e.g., white or black) is closer to the pixel, embodiments may enable the pixel calibration without leading to a flashing effect that may result from forcing all pixels to white or forcing all pixels to black.

Moreover, in some cases following the application of de-ghosting voltage(s) to alter the pixel state to white or black, additional voltage(s) may be applied to the pixel to balance the integrated charge for the pixel. In an electrophoretic display, a positive or negative charge may accumulate over time in a microcapsule if the integral of voltages applied to that microcapsule over time is non-zero. Such charge accumulation may lead to a physical degradation of the microcapsule. Accordingly, embodiments operate to apply charge-balancing voltages to one or more pixels after those pixels have been altered to either white or black during the de-ghosting operations. Application of such charge-balancing voltages may not change the color state of the pixels (given that they have been already changed state to fully white or fully black), but may serve to balance the charge accumulation for the pixels and prevent degradation of the microcapsules.

Instead of using predefined wave-forms (e.g., wave-forms determined at manufacture time and provided with the display by the manufacturer), embodiments employ a computational model of the behavior of the electronic ink to determine how to drive it in order to reach a desired gray value at a pixel. Accordingly, embodiments may obviate the need for software developers to write a separate operating system and/or applications for electronic paper displays, and instead repurpose software already written for other displays (e.g., LCD displays). This may allow for more interactive software and/or more fluid animations, multimedia, and/or gaming applications.

Illustrative Computing System Architecture

FIG. 1 depicts an example computing device 100 that may implement various embodiments described herein. For example, computing device 100 may depicts an electronic book (eBook) reader, tablet, or other computing device that employs an electrophoretic display, or other type of display. In the example shown in FIG. 1, computing device 100 is an eBook reader that includes an electrophoretic display 102, shown displaying a portion 104 of a content item, in this example "The Wonderful Wizard of Oz" by L. Frank Baum. In this example, the display 102 is an electrophoretic display that includes a plurality of microcapsules filled with charged pigment particles, each microcapsule providing a pixel of a displayed image. As used herein, the term pixel may refer to the displayed pixel of an image or may refer to the microcapsule with a charge state that determines a color or brightness state of a corresponding pixel in the display.

Computing device 100 may include one or more processing units 106 (e.g., processors) which may be implemented as hardware, software, or some combination thereof. Processing unit(s) 106 may execute computer-executable, processor-executable, and/or machine-executable instructions written in any suitable programming language to perform various functions described herein. In some embodiments, processing unit(s) 106 include one or more System on Chips (SOCs), such as the Open Multimedia Applications Platform (OMAP) system developed by Texas Instruments®. In some embodiments, processing unit(s) 106 include an OMAP 3 processor.

In addition to a main processor, processing unit(s) 106 may also include a display controller 108 and dedicated processing 110. The dedicated processing 110 may be a digital signal processor (DSP), a graphic processing unit, a single- or multi-core central processing unit (CPU), or hard-coded logic (e.g., hard-coded in silicon). In some embodiments, the display controller 108 operates to send information to the display describing the frames (or sub-frames) to be displayed. Although display controller 108 and dedicated processing 110 are shown as hardware components of the processing unit(s) 106, in some embodiments these components may be implemented at least in part as software (e.g., as part of the operating system or other firmware on computing device 100).

In the example shown, dedicated processing 110 includes a model buffer 112, lookup tables 114, sub-frames queue 116, and logic 118. In some embodiments, model buffer 112 stores data describing a modeled current state of each pixel in the display 102, where the modeled current state is a prediction of the current color state of a pixel based on previously known state(s) of the pixel and/or voltage(s) previously applied to the pixel to change its state. Lookup tables 114 may store information mapping a current pixel state to a result pixel state based on various voltages applied to the current state. Sub-frames queue 116 may store data for one or more sub-frames to be provided to the display during a time period to display a frame. Logic 118 includes software logic (e.g., instructions) to perform various operations described herein, such as updating the model buffer 112 based on voltage(s) applied to pixels of the display.

As shown, computing device 100 may also include a computer-readable memory 120, which may include volatile memory such as random access memory (RAM), static random access memory (SRAM), dynamic random access memory (DRAM), cache memory, and the like. In some embodiments, computer-readable memory 120 includes one or more operating systems (OS) 122, and one or more processes including components, programs, or applications that are loadable and executable by processing unit(s) 106. Computer-readable memory 120 may also store one or more files, tables, databases, and/or other data structures. In the example shown, computer-readable memory 120 includes one or more content items 124 such as eBook content files, and a reader component 126, e.g., a program that reads and interprets content item(s) 124 for display.

Computer-readable memory 120 may also include one or more display driver(s) 128, each of which may include a frame buffer 130. Although the frame buffer 130 is depicted as part of the display driver(s) 128, embodiments are not so limited. For example, in some embodiments the frame buffer 130 may be a separate component from display driver(s) 128 in computer-readable memory 120. In some embodiments, computer-readable memory 120 may also include charge data 132, describing a current accumulated charge for one or more pixels of the display 102.

Computer-readable memory 120 may include non-removable and/or removable storage, such as a hard drive, magnetic disk storage, optical disk storage, tape storage, storage arrays, storage area networks, network attached storage, cloud storage, and the like. Thus, computer-readable media 120 may provide volatile and/or non-volatile storage of computer readable instructions, data structures, program modules, and other data for the operation of computing device 100.

As used herein, computer-readable media may include two distinct types of media: storage media and communications media. With regard to storage media, embodiments may be provided as a computer program product stored on a non-transitory computer-readable or machine-readable storage medium. Computer-readable or machine-readable storage media includes tangible and/or non-transitory forms of media such as volatile and/or non-volatile memory. Such media may be included in a device and/or hardware component that is part of a device or external to a device, including but not limited to random-access memory (RAM), SRAM, DRAM, read-only memory (ROM), erasable programmable read-only memory (EPROM), electrically erasable programmable read-only memory (EEPROM), flash memory, compact disc read-only memory (CD-ROM), digital versatile disks (DVDs), optical cards or other optical storage media, magnetic cassettes, magnetic tape, magnetic disk storage, magnetic cards or other magnetic storage devices or media, solid-state memory devices, or any other non-transmission memory, device, and/or medium that can be used to store and maintain information for access by a computing device. Computer storage media may store information in the form of instruction sets, data structures, applications, program modules and the like, that may be used to program a computing device or processor and thus enable a computing device or processor to perform actions. The stored information may be stored in a compressed or uncompressed form.

In contrast to the tangible storage media described above, communication media is non-tangible (e.g., transitory) and may include data (e.g., computer instruction sets, data structures, program modules, and the like) transmitted in a modulated data signal such as a carrier wave. Embodiments may also be provided as a computer program product including a transitory machine-readable signal (in compressed or uncompressed form). Examples of machine-readable signals, whether modulated using a carrier or not, include but are not limited to signals that a computer system or machine hosting or running a computer program can be configured to access, including signals downloaded through the Internet or other networks. For example, distribution of software may be via Internet download. Thus, tangible computer storage media does not include non-tangible communication media.

Computing device 100 may further include one or more input/output (I/O) interfaces 134 to allow computing device 100 to communicate with other devices such as user input peripheral devices (e.g., a keyboard, a mouse, a pen, a game controller, a voice input device, a touch input device, gestural input device, and the like), and/or output peripheral devices (e.g., a display, a printer, audio speakers, a haptic output, and the like). Computing device 100 may also include one or more network interfaces 136 to enable communications between computing device 100 and other networked devices. Such network interfaces 136 may include one or more network interface controllers (NICs) or other type of transceiver device to send and receive communications over a network.

Further, computing device 100 may also include one or more temperature sensors 138 to measure a current temperature of computing device 100 and/or one or more components of computing device 100. Moreover, although not depicted in FIG. 1, computing device 100 may also include one or more busses and/or other internal communications hardware or software that allow for the transfer of data and/or internal communications between the various components of computing device 100.

In some embodiments, a process flow for sending data for display on display 102 may proceed as follows. First, processing unit(s) 106 may write a frame to be displayed into frame buffer 130, based on information received from reader component 126 processing a content item 124. The dedicated processing 110 may access and/or read the frame buffer 130, and based on the logic 118, the model buffer 112, and/or lookup tables 114, determine one or more sub-frames to write into the sub-frames queue 116. This determination may be based on a determination of voltage(s) that optimally move the state of each pixel toward a target state to display the frame in the display, as described further herein. In some embodiments, a queue of at least four sub-frames may be kept in sub-frames queue 116 to prevent delay in processing. The display controller 108 may read each sub-frame out of the queue and send it on to the display. In this way, the display controller 108 may manage the timing of sending sub-frames to the display.

Illustrative Environment

Figure 2:
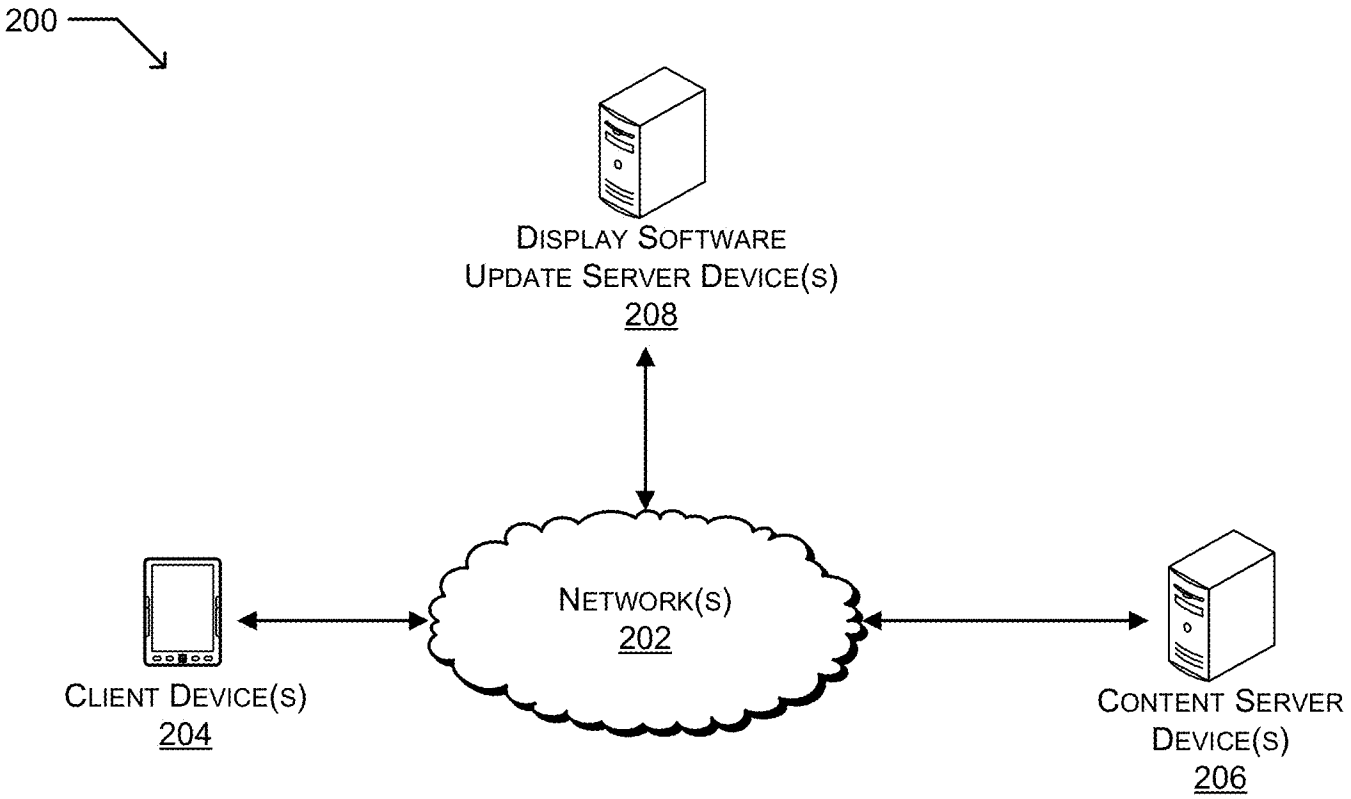
FIG. 2 depicts a diagram of an example environment in which embodiments may operate.

FIG. 2 shows an example environment 200 in which embodiments may operate. In embodiments, the various devices and/or components of environment 200 may communicate with one another and with external devices via one or more networks 202. For example, networks 202 may include public networks such as the Internet, private networks such as an institutional and/or personal intranet, or some combination of private and public networks. Networks 202 may also include any type of wired and/or wireless network, including but not limited to local area networks (LANs), wide area networks (WANs), Wi-Fi, WiMax, and mobile communications networks (e.g. 3G, 4G, and so forth). Networks 202 may utilize communications protocols, including packet-based and/or datagram-based protocols such as internet protocol (IP), transmission control protocol (TCP), user datagram protocol (UDP), or other types of protocols. Moreover, networks 202 may also include a number of devices that facilitate network communications and/or form a hardware basis for the networks, such as switches, routers, gateways, access points, firewalls, base stations, repeaters, backbone devices, and the like.

In some embodiments, environment 200 includes one or more client devices 204, such as the computing device 100 shown in FIG. 1. In one example, client device(s) 204 may include eBook readers or other devices that incorporate an electrophoretic display to display information. However, embodiments are not limited to a particular type of client device, and client device(s) 204 may include any type of computing device that is able to display information, including but not limited to desktop computers, personal computers, laptop computers, tablet computers, eBook readers, wearable computers, mobile phones, automotive computers, thin clients, terminals, personal data assistants (PDAs), game consoles, mobile gaming devices, and the like.

In some embodiments, environment 200 includes one or more server computing devices such as content server device(s) 206 and display software update server device(s) 208. Such server devices may include any type of computing device including, but not limited to, network servers, workstations, desktop computers, laptop computers, tablet computers, mobile computing devices, and the like. Further, the server devices shown may include one or more computing devices that operate in a cluster or other grouped configuration to share resources, balance load, increase performance, provide fail-over support or redundancy, or for other purposes.

In some embodiments, content server device(s) 206 include one or more hardware and/or software components for an e-commerce service, content provision service, or other services to provide content to be displayed on client device(s) 204. For example, content item(s) 124 may be purchased from or otherwise provided by a web site hosted by content server device(s) 206. In some embodiments, environment 200 may also include one or more display software update server device(s) 208 to provide initial installations and/or updates of display software for client device(s) 204. For example, in some embodiments one or more components (e.g., lookup tables 114, logic 118, and/or other components) of computing device 100 may be software components stored in memory (e.g., computer-readable media 120) instead of hardware components of processing unit(s) 106. In such cases, display software update server device(s) 208 may provide software updates to client device(s) 204 to improve display software performance, fix bugs, update software to support different file formats or display formats, and so forth.

Illustrative Processes

Figure 3:
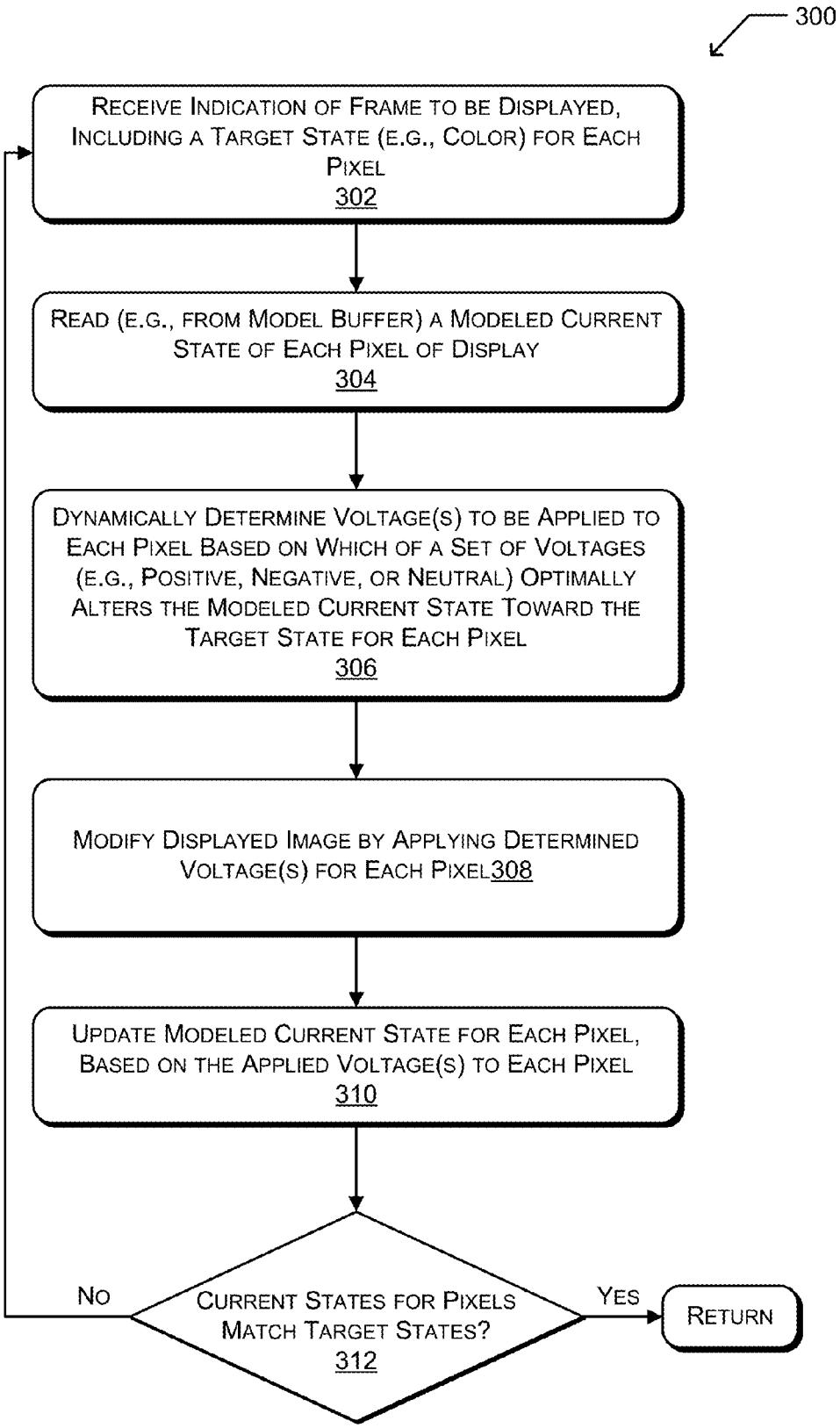
FIG. 3 depicts an illustrative process flow diagram for dynamically updating an electrophoretic display, according to embodiments.
Figure 4:
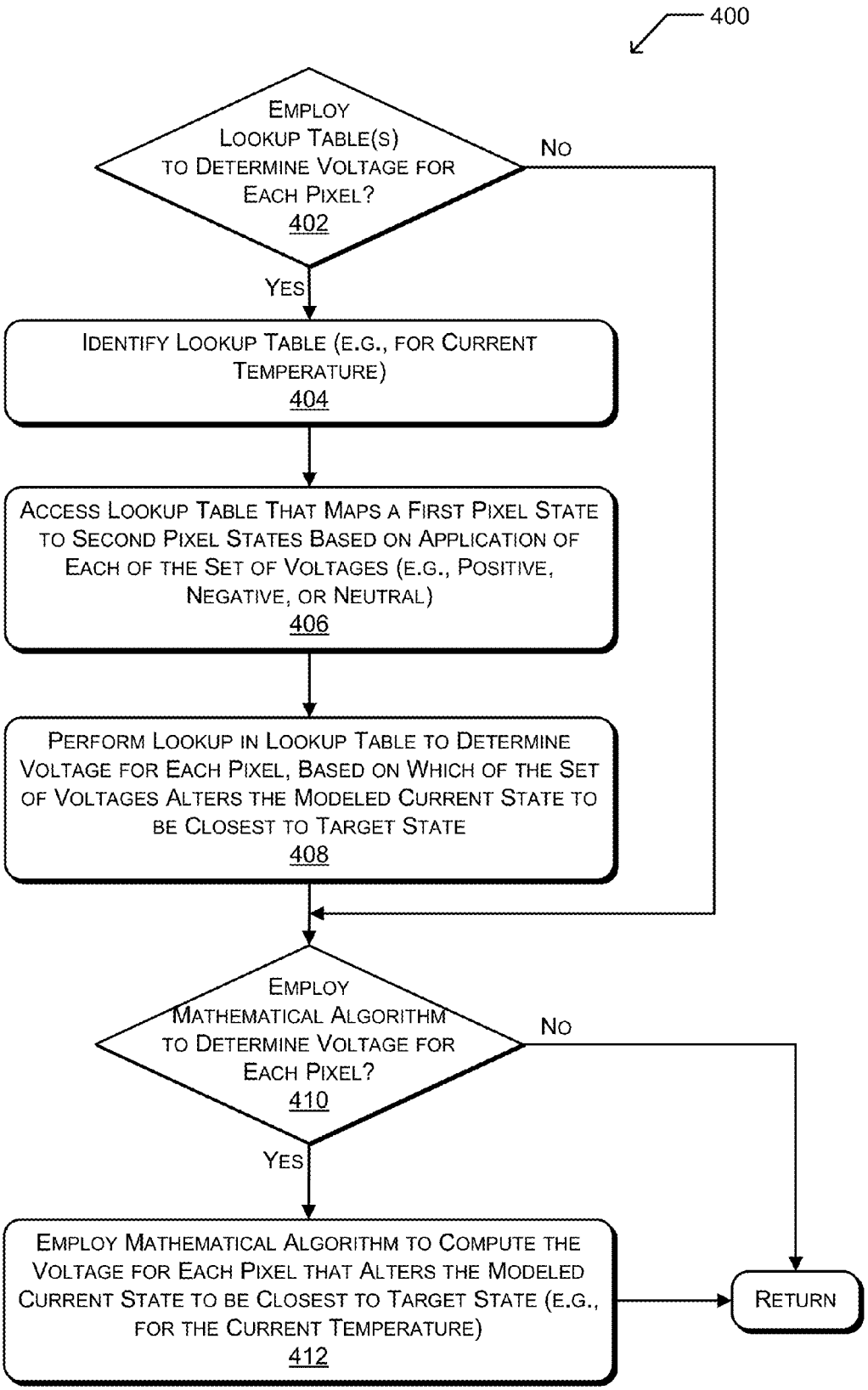
FIG. 4 depicts an illustrative process flow diagram for dynamically determining voltages to apply to pixels in an electrophoretic display, according to embodiments.
Figure 6:
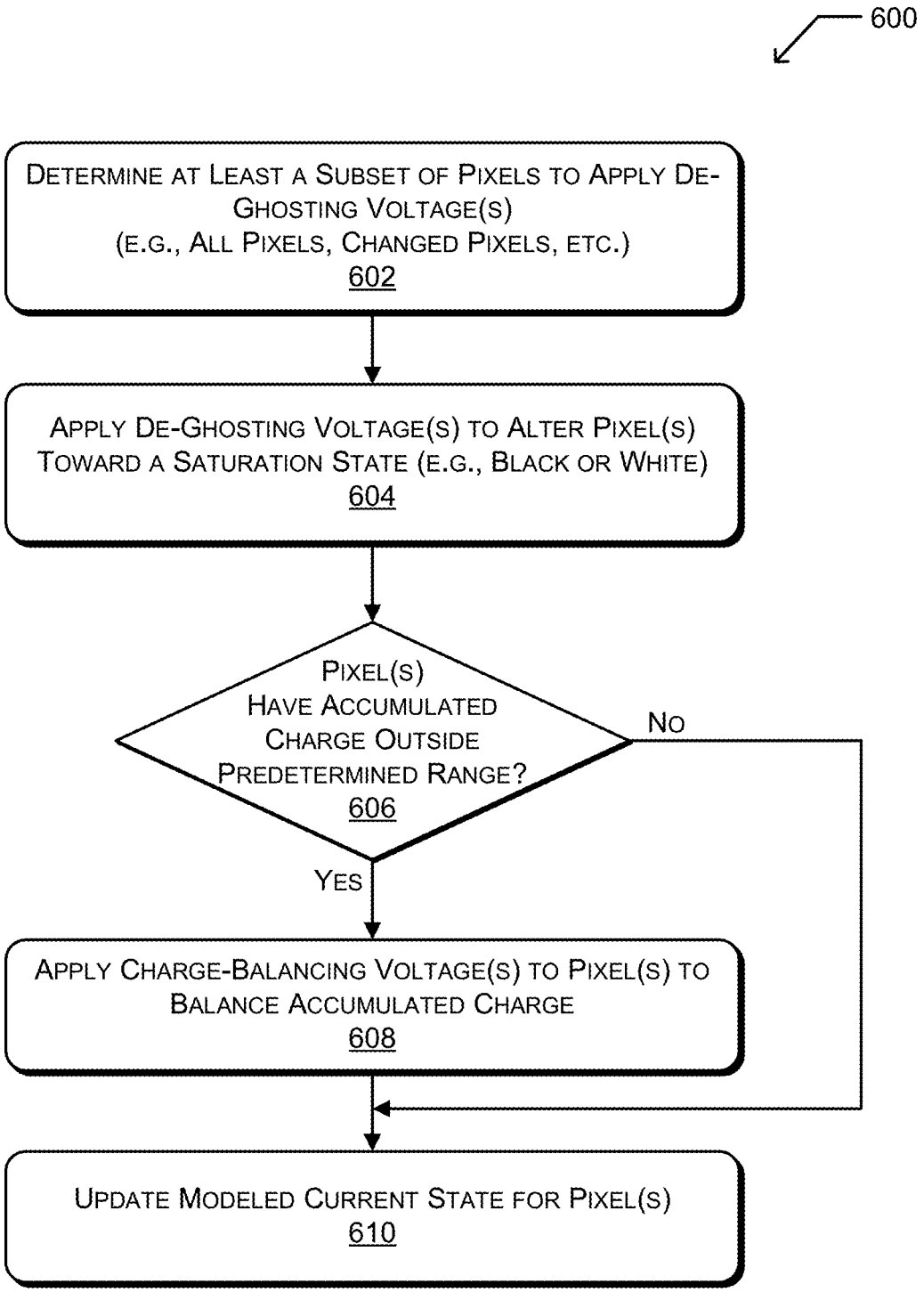
FIG. 6 depicts an illustrative process flow diagram for de-ghosting and/or charge-balancing pixels in an electrophoretic display, according to embodiments.

FIGS. 3, 4, and 6 provide an illustration of embodiments in the form of a flowchart. The operations of the example processes are illustrated in individual blocks and summarized with reference to those blocks. The processes are illustrated as logical flow graphs, each operation of which may represent one or more operations that can be implemented in hardware, software, or a combination thereof. In the context of software, the operations represent computer-executable instructions stored on one or more computer storage media that, when executed by one or more processors, enable the one or more processors to perform the recited operations. Generally, computer-executable instructions include routines, programs, objects, modules, components, data structures, and the like that perform particular functions or implement particular abstract data types. The order in which the operations are described is not intended to be construed as a limitation, and any number of the described operations may be executed in any order, combined in any order, subdivided into multiple sub-operations, and/or executed in parallel to implement the described process.

FIG. 3 depicts an illustrative process 300 for dynamically updating an electrophoretic display, according to embodiments. In some embodiments, process 300 may be executed as part of logic 118 or some other component of dedicated processing 110, display controller 108, or in software stored on computer-readable memory 120 of computing device 100. At 302, an indication is received of a frame to be displayed, the frame including data describing a target state (e.g., color or brightness state) for each pixel in the display that is to display the frame. In some embodiments, the frame to be displayed may be received from an application that reads and interprets content items to be displayed.

At 304, the modeled current state for each pixel of the display is read. In some embodiments, the modeled current state is stored and updated in a model buffer that resides in memory or that is part of the display controller 108 or dedicated processing 110. In some embodiments, the modeled current state provides an estimate or a prediction of the current color or brightness of each pixel in the display, the estimate or prediction based on voltages previously applied to the pixel.

At 306, a voltage to be applied to each pixel is dynamically determined based on which of a set of voltages optimally alters the modeled current state for the pixel toward the target state for the pixel. In some embodiments, the voltage is selected from a set of voltages that includes, for example, a positive voltage, a negative voltage, and a neutral voltage. For a sub-frame, the voltage may be selected for each pixel as which of the set of voltages optimally alters the state of the pixel from the modeled current state toward the target state. Thus, during the sub-frame within the time scale to display a frame, the pixel state may be moved as close as possible to the target state even if, in some cases, the pixel state does not reach the target state. The determination of a voltage to be applied for each pixel is described further with respect to FIG. 4.

At 308, the image displayed is modified by applying the dynamically determined voltage for each pixel. In some embodiments, voltage may be applied to each pixel during an iteration corresponding to the sub-frame. At 310, the modeled current state for each pixel is updated based on the voltage applied to each pixel during the sub-frame. In some embodiments, this update is applied to the model buffer which stored the modeled current state for each pixel. In this way, the model buffer may be described as keeping a running current state of each pixel as it changes over time based on applied voltages.

In some embodiments, each sub-frame may include information describing the voltage to apply to each pixel during that sub-frame. This information may include a two-bit number for each pixel indicating whether to apply a positive voltage, a negative voltage, or a neutral voltage. For example, a positive voltage may be indicated by 01, and may be applied to alter the pixel to be darker. A negative voltage may be indicated by 10, and may be applied to alter the pixel to be lighter. A negative voltage may be indicated by 00. In this example, the number 11 may be unused.

At 312, a determination is made as to whether the current, modeled state for each pixel matches the target state for that pixel. If not, additional iterations of the operations shown at 302-310 may be performed for additional sub-frames until either (A) the current, modeled states match the target states or (B) a new frame is received.

FIG. 4 depicts an illustrative process 400 for dynamically determining voltages to apply to pixels in an electrophoretic display, according to embodiments. In some embodiments, process 400 may be executed as part of logic 118 or some other component of dedicated processing 110, display controller 108, or in software stored on computer-readable memory 120 of computing device 100. Embodiments support determination of each voltage based on information in a lookup table, application of a mathematical algorithm, or some combination of these methods.

At 402, a determination is made whether one or more lookup table(s) are to be employed to determine a voltage to apply to each pixel in the display. If so, then at 404 a lookup table is identified for use. In some embodiments, identification of the lookup table is based at least in part on the current temperature of the display or other portion(s) of the device that includes the display. In some cases, microcapsules of an electrophoretic display may respond differently to applied voltages based on their current temperature. Accordingly, some embodiments determine voltages to be applied based at least in part on temperature. For example, a plurality of lookup tables may be used, each corresponding to a particular range of temperatures.

At 406, the identified lookup table is accessed to determine the voltage to be applied to each pixel of the display. In some embodiments, the lookup table maps a current voltage to a result voltage that results from application of each of a set of voltages (e.g., positive, negative, or neutral). An example lookup table is described in further detail with respect to FIG. 5A. At 408, a lookup is performed in a lookup table to determine which voltage optimally alters a pixel from its modeled current state toward the target state for a frame to be displayed. In some cases, this includes determining the voltage that alters the modeled current state of the pixel to be as close as possible to the target state.

At 410, a determination is made whether to employ a mathematical algorithm to determine the voltage for each pixel. If so, then at 412 the mathematical algorithm is employed. In some embodiments, the algorithm is in the form of a function that accepts as input the target state and the modeled current state of the pixel, and outputs the voltage to be applied to optimally alter the pixel toward the target state from its modeled current state. In some embodiments, the function may also accept current temperature as an input parameter. Embodiments may support any type of function that models the state-change behavior of a pixel based on applied voltage and/or temperature. For example, embodiments may employ a polynomial function and/or a piecewise-defined polynomial function (e.g., a spline function). In general, the algorithm f may be expressed mathematically as:

$$V_i = f(s_{i,current} s_{i,target} T)$$

where $V_i$ is the voltage to apply to a pixel i, $s_{i,current}$ is the current state (e.g., color, hue, or brightness state) for pixel i, $s_{i,target}$ is the target state for pixel i, and T is the current temperature of the system.

Having determined a voltage to apply to each pixel in the display, through a lookup table and/or mathematical algorithm, process 400 may return.

In some embodiments, the techniques illustrated at 402-408 and at 410-412 may be employed separately or in an order different from that shown.

Figures 5A, 5B:
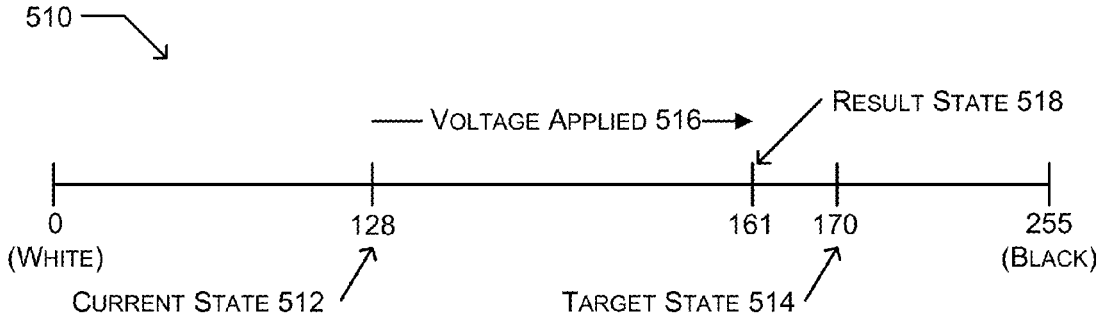
FIG. 5A depicts an example lookup table for dynamically determining voltages to apply to pixels in an electrophoretic display, according to embodiments.
FIG. 5B illustrates an example application of voltage to alter a pixel state, according to embodiments.

FIG. 5A depicts an example lookup table 500 for dynamically determining voltages to apply to pixels in an electrophoretic display, according to embodiments. In the example shown, the lookup table includes a column 502 for the current state of a pixel (e.g., a color state), a column 504 for an applied voltage, and a column 506 for a result state that may result from applying the voltage to a pixel in the current state. Lookup table 500 may have any number of rows corresponding to a number of pixel states supported by embodiments. In the example shown, 256 pixels states from 0 to 255 are supported, expressible as an eight-bit number. Lookup table 500 may be arranged into blocks of rows. For example, block 508 includes three rows that map a particular current state (e.g., 128) to a result state based on application of each of a set of three voltages (e.g., positive, negative, and neutral). In other embodiments, a different number of voltages may be applied to each current state. Also, while FIG. 5*a* illustrates a positive voltage making a pixel darker and a negative voltage making a pixel lighter, the reverse could be the case; positive voltage could make a pixel lighter and negative voltage make a pixel darker. Further, the lookup table 500 may include additional column(s) for previously applied voltage(s). For example, if the current state is 128, the result state may depend not only on the voltage to be applied, but on voltages previously applied.

FIG. 5B depicts an example application 510 of voltage to alter a pixel state, according to embodiments. In the example shown, a pixel has a current state 512 (e.g., as modeled in the model buffer) with a value of 128, and a target state 514 with a value of 170. As described above, a target state for the pixel may be that state that is targeted to display a particular image. A determination may be made that the voltage applied 516 is that voltage that optimally alters the pixel state to be as close as possible to the target state. Based on the example table of FIG. 5A, a determination may be made that the positive voltage optimally alters the pixel state from current state 128 toward target state 170. Following application of the voltage, the result state 518 of the pixel may have a value of 161. Accordingly, following application of this voltage, the modeled current state of the pixel may be updated to 161.

FIG. 6 depicts an illustrative process 600 for de-ghosting and/or charge-balancing pixels in an electrophoretic display, according to embodiments. In some embodiments, process 600 may be executed as part of logic 118 or some other component of dedicated processing 110, display controller 108, or in software stored on computer-readable memory 120 of computing device 100.

In some cases, a display such as an electrophoretic display may exhibit memory effects, such that it may retain a residual state based on previously displayed images. In embodiments, because embodiments keep track of a modeled current state for each pixel based on voltages previously applied, the modeled current state for a pixel may over time diverge from the actual current state of the pixel.

Accordingly, embodiments may employ additional steps to current, or de-ghost one or more pixels through application of one or more de-ghosting voltages. In some embodiments, a goal may be to apply de-ghosting voltage(s) to a pixel to alter that pixel into a known state, effectively calibrating that pixel prior to application of voltage(s) for displaying an image (e.g., prior to process 300 and/or 400).

At 602, at least a subset of the pixels of a display are determined for application of de-ghosting voltages. In some embodiments, all pixels may be de-ghosted periodically (e.g., once every N frames). In other embodiments, a subset of pixels may be periodically determined for de-ghosting. For example, in some embodiments, the display may be divided into a number of regions (e.g., four regions), with each region de-ghosted in turn following a certain time period and/or number of frames. As another example, the pixels in the display may be divided into subsets that are substantially evenly distributed over the area of the display, e.g., via application of a bitmask to the pixels. In this example, bitmasks may be selected such that two pixels being de-ghosted are maximally far apart from each other in either or both of the horizontal and vertical directions. Such application of bitmasks may allow for an evenly distributed grid of pixels that are being de-ghosted at any particular time, and may minimize visual artifacts (e.g., visible to the user) during the de-ghosting.

Moreover, in some embodiments a decision may be made to clean up those pixels that are more likely to have incurred variations between their modeled state and actual state. For example, a determination may be made that those pixels that have changed more frequently and/or more recently may be more likely to have a modeled current state that has diverged from the actual state, and de-ghosting voltage(s) may be applied to those pixels. Further, in such cases a determination may be made not to apply de-ghosting voltages to those pixels that have not changed recently (e.g., within a certain threshold time period or number of frames). Moreover, a determination may be made to not apply de-ghosting voltages to pixels that are being altered from black to white or vice versa, given that such pixels are moving to known states (e.g., the extremes of white or black) and therefore may be less likely to incur ghosting errors or anomalies. Moreover, some embodiments may model the pixels based on how much error a user would be likely to perceive, and apply de-ghosting voltages to those pixels that may most perceivably display anomalies.

At 604, one or more de-ghosting voltages may be applied to the pixel(s) determined at 602. In some embodiments, de-ghosting voltages may be determined based on those voltages that alter the pixel(s) toward saturation state for the pixel (e.g., either fully black or fully white), such as the nearer saturation state for that pixel. In some embodiments, one saturation state or the other may be selected based on the charge balance for the pixel(s) or on a history of voltages applied to the pixel. Determination of de-ghosting voltages may be based on a lookup table and/or algorithm as described above. By applying de-ghosting voltages, the pixels corrected may be moved toward a known state (e.g., black or white).

In some displays, color change may occur more rapidly when voltages are first applied to a pixel. Accordingly, in some embodiments moving a pixel toward the saturation state (e.g., black or white) may include moving away from the saturation state in a first, large step, then moving back toward the saturation state in subsequent steps. Accordingly, in some embodiments more than one de-ghosting voltage may be applied to a pixel to perform the calibration. Moving each pixel toward the closer of black or white may minimize a flashing effect visible to the user, as compared to moving all the pixels to black or moving all the pixels to white.

In some displays, a positive or negative charge may accumulate over time in a microcapsule if the integral of voltages applied to that microcapsule over time is non-zero. Such charge accumulation may lead to a physical degradation of the microcapsule. To correct for this effect, embodiments may provide for the application of one or more charge-balancing voltages to pixel(s) of the display. In some embodiments, charge information (e.g., charge data 132) may be stored and updated for each pixel based on the voltages applied to that pixel. This charge information may be in the form of a counter keeping count of the charge on each pixel. At 606, a determination may be made whether the accumulated charge for one or more pixels is outside a certain predetermined range, e.g. higher than a predetermined upper threshold indicating an excess of positive charge, or lower than a predetermined lower threshold indicating an excess of negative charge.

If so, at 608 one or more charge-balancing voltages may be applied to the pixels to balance the accumulated charge for those pixels. This may involve, as discussed with respect to 604, moving the pixels towards a saturation state to balance the charge for those pixels. In some embodiments, the charge-balancing voltages are applied after the de-ghosting process has been performed for one or more pixels. Application of such charge-balancing voltages may not change the color state of the pixels (given that they have already changed state to fully white or fully black), but may serve to balance the charge accumulation for the pixels and prevent degradation of the microcapsules.

At 610, following application of de-ghosting and/or charge-balancing voltages to one or more pixels, the modeled current state for those pixels may be updated in the model buffer to reflect their current state.

Example Lookup Table Generation

Embodiments, rather than using predefined wave-forms, use a computational model of the behavior of the electronic paper display to decide how to drive it in order to reach a desired gray value at a pixel. To create the computational models employed by embodiments, experiments were performed to drive the display in a controlled manner and record the results. The experiments employed a TI OMAP3 processor connected to an electronic paper display. Rather than driving the display with the standard algorithms and waveforms provided by the display manufacturer, experiments were first performed driving the display using a sequence of frames. In these experiments, a frame consisted of a series of bytes representing the desired change to the image on the display. An electronic paper display physically remembers, to a certain degree, what was drawn to it because driving the display physically moves black and white pigments. Thus, each update in each frame is specifying a change in brightness for each pixel rather than an absolute brightness.

In the experiments, each byte stored information for four contiguous display pixels, with each pixel being controlled by a two bit code. For example, a code of 00 indicates to keep this pixel at the current color; a code of 01 indicates to make this pixel one step darker; and a code of 10 indicates to make this pixel one step lighter. A code of 11 was not employed. On a display with a frequency of 85 Hz, a frame is sent to the display 85 times per second. In the experimental setup, the system was able to send frames at higher rates—up to 210 frames per second. Moreover, in the experimental setup frames were sent directly to the display, and a utility was employed that enabled frames to be sent directory to the display. Sequences of frames are referred to herein as "movies."

Figure 7:
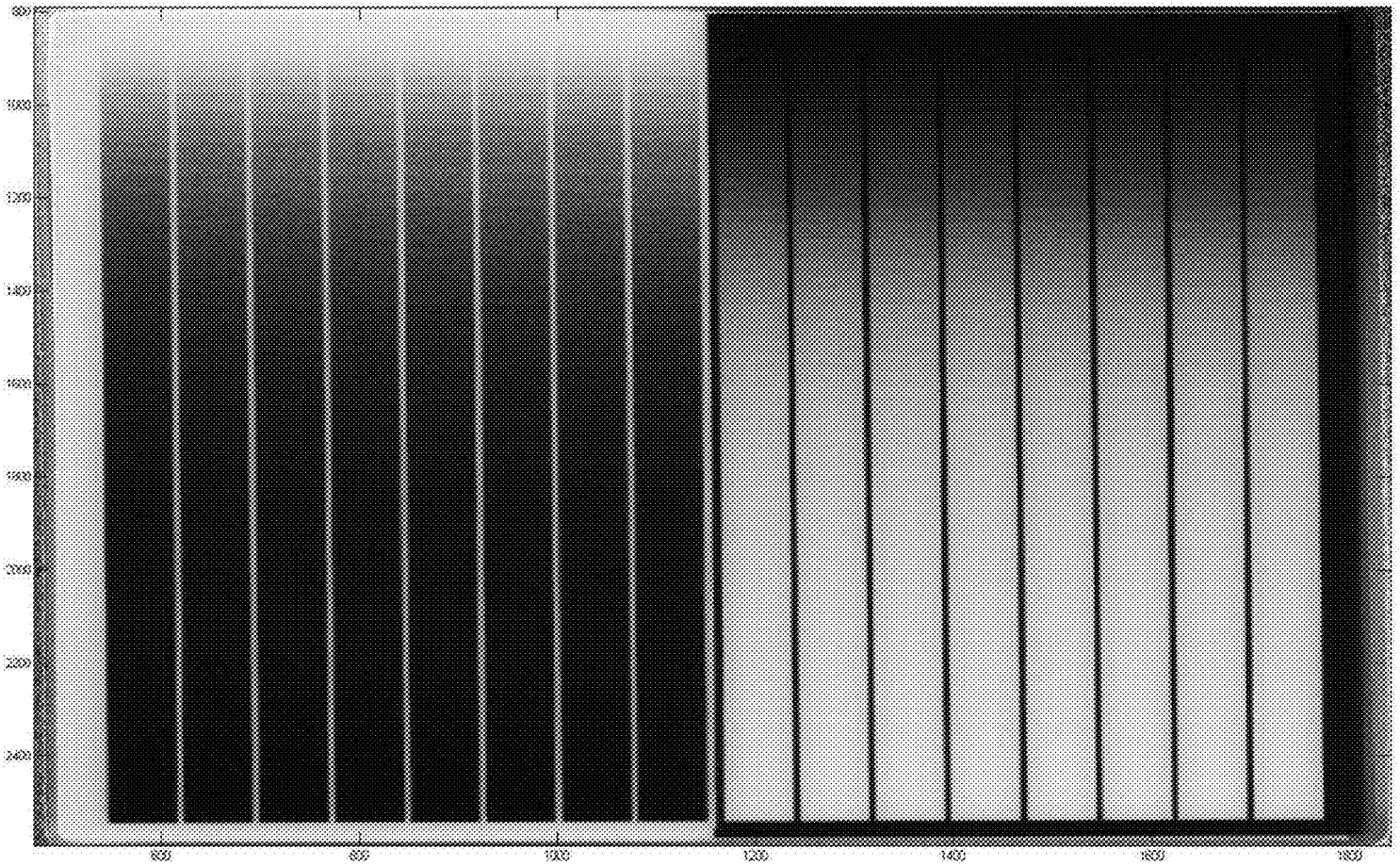
FIG. 7 shows an example test pattern image for experimentally developing a computational model for voltage determination in an electronic paper display, according to embodiments.

Experiments employed software to generate various movies, which drove each pixel in the display with a known sequence of codes. Then, an accurate camera was used to measure the gray states of the pixels after various movies were played, and these measurements enabled a characterization of the way in which the electronic paper material responded to the various sequences of voltages generated by the codes. FIG. 7 shows an example image of one of the test patterns after processing to compensate for imperfections in the camera and lighting, and following normalization to a human-perceptual scale using a gamma of 2.0.

Experiments showed that electronic paper has a complex behavior. For example, the amount of change in brightness caused by application of a voltage to a pixel depends on the current brightness of the pixel, the voltage applied (e.g., positive, negative, or neutral), the sequence of voltages applied previously (e.g., demonstrating a history or momentum effect), and the voltages applied to neighboring pixels. Based on this information, a computational model was generated that predicted the resulting shade of electronic paper based on the application of a sequence of codes. This model was applied to determine what sequence of codes may be used to reach a given shade in a pixel. However, even when applying the model, some amount of ghosting was present. For example, a memory of previously shown images was visible in later images.

Experiments were then performed to attempt to run the model on the DSP of an OMAP3 processor. However, experiments showed that the model was sufficiently complex that it surpassed the abilities of the OMAP to run it in real-time. Experiments determined that the OMAP3 DSP was capable of performing one or two table lookups, along with some logical instructions, during the time-scale to display a pixel. Accordingly, an analysis was performed to capture the curve that occurs as a pixel transitions from white to black and from black to white. To capture the data for the curve, the display was driven at 210 Hz instead of the standard 85 Hz to obtain more data points on a given transition.

Based on this data, a lookup table was created for the OMAP3 to use. To generate the table, software was written that computed, for any given brightness value, what the resulting color would be if a darker step were taken (01), if a lighter step were taken (10), or if a neutral step were taken (00) by interpolating the data points in the data curves. Moreover, a somewhat more complex table was also generated that took into account the previous voltage applied, thus modeling the momentum or history effect. However, experiments showed that the OMAP3 was not fast enough to use such a table in real-time. Use of processors that include a faster DSP may enable the employment of this second table and other more complex models for more accurate brightness reproduction.

Each lookup table may be generated for a specific display or a specific batch of displays using the experimental techniques described above.

CONCLUSION

Although the techniques have been described in language specific to structural features and/or methodological acts, it is to be understood that the appended claims are not necessarily limited to the specific features or acts described. Rather, the specific features and acts are disclosed as example implementations of such techniques.

What is claimed is:

1. A computer-implemented method comprising:

maintaining a model buffer that provides a modeled current state of a pixel of a first plurality of pixels of a display, the modeled current state corresponding to a current predicted color of the pixel;

receiving an indication of a frame to be displayed after a frame period, the indication including a target state for the pixel, the frame period divided into a plurality of sub periods including a first sub period and a second sub period, wherein a first voltage is applied to the pixel in the first sub period and a second voltage is applied to the pixel in the second sub period;

determining, based at least in part on the modeled state of the pixel, the first voltage to be applied to the pixel at the first sub period within a frame period;

applying the first voltage to the pixel at the first sub period;

updating the modeled current state of the pixel, within the model buffer, to reflect the first voltage applied to the pixel at the first sub period;

determining, based at least in part on the modeled state of the pixel, the second voltage to be applied to the pixel at the second sub period within the frame period;

applying the second voltage to the pixel at the second sub period;

updating the modeled current state of the pixel, within the model buffer, to reflect the second voltage applied to the pixel at the second sub period; and applying one or more de-ghosting voltages to a subset of the first plurality of pixels to alter the subset of the first plurality of pixels toward a saturation state based at least partly on a determination that the subset of the first plurality of pixels has been altered a threshold number of times.

2. The method of claim 1, further comprising performing iterations of the determining, the modifying, and the updating until the current state of the pixel matches the corresponding target state for the pixel or until a new frame is provided for display.

3. The method of claim 1, wherein determining the first voltage to be applied to the pixel further includes:

accessing a lookup table that maps a first state of the pixel to second states of the pixel, the second states being respectively associated with application of a positive voltage, a negative voltage, and a neutral voltage to the first state; and using the current state of the pixel as the first state, performing a lookup in the lookup table to determine which of the second states is closest to the target state, and selecting the voltage associated with the determined second state to use in performing the modifying.

4. The method of claim 1, further comprising:

applying one or more charge-balancing voltages to at least one pixel of the subset of the first plurality of pixels after the at least one pixel has reached the saturation state to balance an accumulated charge of the at least one pixel, based on a determination that the accumulated charge of the at least one pixel is outside a predetermined range.

5. The method of claim 1, wherein the display is an electrophoretic display.

6. A computer-implemented method comprising:

receiving an indication of a frame to be displayed on a display at an end of a frame period, the indication including a target state for a pixel of a plurality of pixels of the display, the frame period comprising a plurality of time periods including a first time period and a second time period, wherein a first voltage is applied to the pixel in the first time period and a second voltage is applied to the pixel in the second time period;

determining the first voltage to apply to the pixel in the first time period based at least on:

a modeled current state of the pixel stored in a model buffer; and accessing a first lookup table, of a plurality of look up tables, that maps a first state of the pixel to second states of the pixel, the first lookup table corresponding to a first range of temperatures and a second lookup table of the plurality of look up tables corresponding to a second range of temperatures that is different than the first range of temperatures, and wherein accessing the first lookup table includes selecting the first lookup table based on a temperature of the pixel;

applying the first voltage at the first time period to the pixel;

updating the modeled current state for the pixel, within the model buffer, based in part on the first voltage applied at the first time;

determining, based at least in part on the modeled current state of the pixel stored in a model buffer, the second voltage to apply to the pixel in the second time period of the plurality of time periods, the second voltage determined to alter the pixel from the modeled current state toward the target state for the pixel;

applying the second voltage at the second time period to the pixel; and updating the modeled current state for the pixel, within the model buffer, based in part on the second voltage applied at the second time.

7. The method of claim 6, wherein the first and second voltages are determined based on which of a positive voltage, a negative voltage, or a neutral voltage alters the modeled current state of the pixel to be closest to the target state for the pixel.

8. The method of claim 6, wherein the modeled current state for the pixel corresponds to a predicted current color for the pixel.

9. The method of claim 6, wherein the display is an electrophoretic display.

10. The method of claim 6, wherein the second states are respectively associated with application of a positive voltage, a negative voltage, and a neutral voltage to the first state; and performing a lookup in the lookup table includes determining a second state that is closest to the target state.

11. The method of claim 10, wherein the lookup table includes indications of previously applied voltages for the pixel.

12. A system comprising:

one or more processors; and a display controller controlled by the one or more processors and operating to:

receive an indication of a frame to be displayed on a display after a frame period, the indication including a target state for a pixel of a plurality of pixels of the display, the frame period comprising a plurality of time periods including a first time period and a second time period, wherein a first voltage is applied to the pixel in the first time period and a second voltage is applied to the pixel in the second time period;

determine, based at least in part on a polynomial function that accounts for at least a modeled current state of the pixel stored in a model buffer, the target state, and a temperature of the pixel, the first voltage to apply to the pixel at the first time period of the plurality of time periods;

modify the pixel by applying the first voltage to the pixel at the first time period;

update the modeled current state for the pixel, within the model buffer, based at least in part on the applied first voltage to the pixel;

determine, based at least in part on the modeled current state of the pixel stored in a model buffer, the second voltage to apply to the pixel at the second time period of the plurality of time periods;

modify the pixel by applying the second voltage to the pixel at the second time period; and update the modeled current state for the pixel, within the model buffer, based at least in part on the applied second voltage to the pixel.

13. The system of claim 12, wherein the display is an electrophoretic display.

14. The system of claim 12, wherein the display controller further operates to store the modeled current state in the model buffer.

15. The system of claim 12, wherein the display controller further operates to:

apply one or more de-ghosting voltages to a subset of the plurality of pixels to alter individual pixels of the subset toward a saturation state; and update the modeled current state for the pixel of the subset in the model buffer based at least in part on the applied one or more de-ghosting voltages.

16. The system of claim 15, wherein the display controller further operates to select the saturation state based on charge balance(s) associated with the subset.

17. The system of claim 15, wherein the subset is one of a predetermined plurality of subsets.

18. The system of claim 15, wherein the subset is determined based on a probability that a current state for individual pixels of the subset has diverged from the modeled current state.

19. The system of claim 12, wherein the display controller further operates to:

apply one or more charge-balancing voltages to at least one pixel of the plurality of pixels to balance an accumulated charge of the at least one pixel, based on a determination that the accumulated charge of the at least one pixel is outside a predetermined range.

20. The system of claim 12, wherein the first and second voltages applied to the pixel are determined further based on a current temperature of the system and a state-change behavior model of the pixel.

21. The system of claim 12, wherein the polynomial function is expressed mathematically as $V_i=f(S_{icurrent}, S_{itarget}, T)$, where $V_i$ is the first voltage to apply to the pixel, $S_{icurrent}$ is the modeled current state of the pixel, $S_{itarget}$ is the target state for the pixel, and T is the temperature of the pixel.

22. One or more computer-readable storage media storing instructions that, when executed, instruct at least one processor to perform actions comprising: receiving an indication of a frame to be displayed in a display at the end of a frame period, the indication including a target state for a pixel of a plurality of pixels of the display, the frame period divided into a plurality of time periods including a first time period and a second time period, wherein a first voltage is applied to the pixel in the first time period and a second voltage is applied to the pixel in the second time period; during the first time period: determining, based at least in part on a polynomial function that accounts for at least a modeled current state of the pixel stored in a model buffer, the target state, and a temperature of the pixel, the first voltage to apply to the pixel in the first time period, the first voltage determined to alter the pixel from the modeled current state toward the target state; applying the first voltage to the pixel; and updating the modeled current state for the pixel, within the model buffer, based at least in part on the applied first voltage to the pixel; during the second time period: determining, based at least in part on a modeled current state of the pixel stored in a model buffer, the second voltage to apply to the pixel in the second time period, the second voltage determined to alter the pixel from the modeled current state toward the target state; applying the second voltage to the pixel; and updating the modeled current state for the pixel, within the model buffer, based at least in part on the applied second voltage to the pixel.

23. The one or more computer-readable storage media storing instructions of claim 22, wherein the first voltage is determined based on which of a positive voltage, a negative voltage, or a neutral voltage alters the modeled current state of the pixel to be closest to the target state.

24. The one or more computer-readable storage media storing instructions of claim 23, wherein the first and second voltages are applied as part of a sub-frame of the frame.

* * * * *